US006454191B1

(12) United States Patent
Spakowski et al.

(10) Patent No.: US 6,454,191 B1
(45) Date of Patent: Sep. 24, 2002

(54) ELECTROMAGNETIC FUEL INJECTOR DAMPENING DEVICE

(75) Inventors: Joseph George Spakowski, Rochester; Jay Keith Sofianek, Webster, both of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/725,422

(22) Filed: Nov. 29, 2000

Related U.S. Application Data

(60) Provisional application No. 60/175,209, filed on Jan. 10, 2000.

(51) Int. Cl.[7] ..... B05B 1/30

(52) U.S. Cl. ..... 239/584; 239/585.1; 239/585.4; 239/900; 239/DIG. 4; 251/129.16; 251/129.21

(58) Field of Search ..... 239/580, 584, 239/585.1, 585.4, 900, 585.5, DIG. 4; 251/129.15, 129.16, 129.18, 129.21

(56) References Cited

U.S. PATENT DOCUMENTS 4,310,123 A * 1/1982 TePastte ..... 239/900
5,044,563 A * 9/1991 Mesenich ..... 239/585.4
5,170,945 A * 12/1992 Daley et al. ..... 239/585.4
5,236,173 A * 8/1993 Wakeman ..... 251/129.16
5,820,101 A * 10/1998 Ricco ..... 239/585.1
6,062,531 A * 5/2000 Rapp et al. ..... 251/129.16
6,279,873 B1 * 8/2001 Eichendorf et al. .... 251/129.21

* cited by examiner

*Primary Examiner*—Steven J. Ganey
(74) *Attorney, Agent, or Firm*—Patrick M. Griffin

(57) ABSTRACT

An electromagnetic fuel injector comprises a body with a fuel inlet and a fuel outlet and a base that comprises a valve seat connected to the body. A moveable valve assembly comprising an armature and a valve outlet member is disposed at the fuel outlet for controlling the flow of fuel from the outlet. Positioned between the armature and valve outlet member is a dampening device that acts on the moveable valve assembly to reduce bounce of the valve outlet member at the valve seat. An electromagnetic fuel injector comprises a body with a fuel inlet and a fuel outlet and a base that comprises a valve seat connected to the body. A moveable valve assembly comprises an armature connected to a valve outlet member that includes a pintle and a ball element that is disposed at the fuel outlet to control the flow of fuel from the outlet. At least one spring, positioned between the armature and the valve outlet member, acts on the moveable valve assembly to reduce bounce of the valve outlet member at the valve seat. An adjuster is provided for adjusting the stroke of the injector after the injector is assembled.

18 Claims, 3 Drawing Sheets

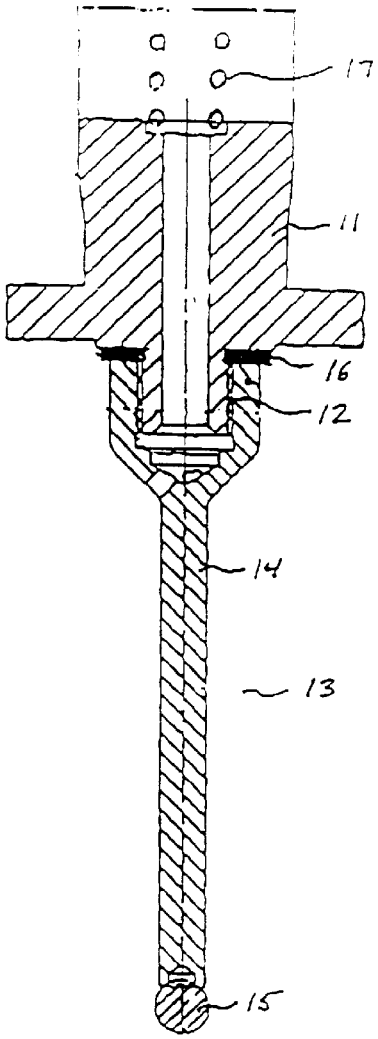
10 FIG. 1
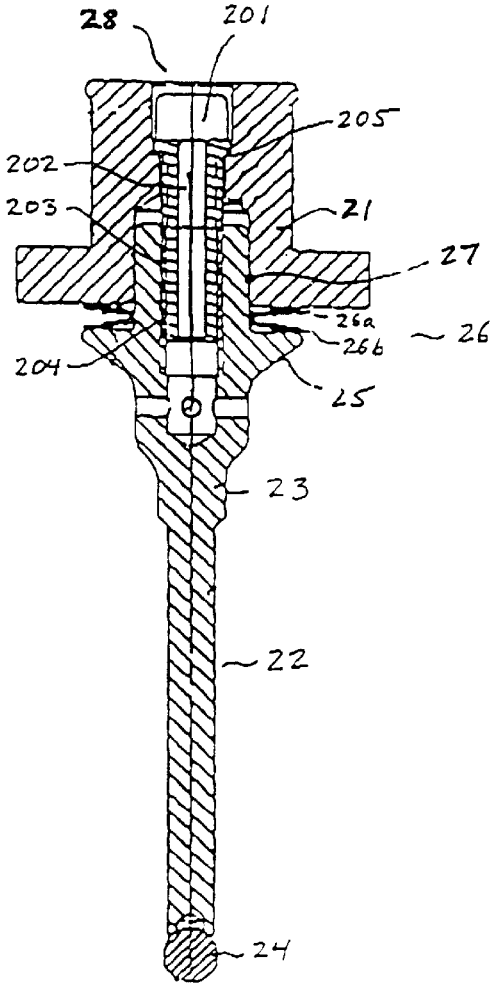
20 FIG. 2

ELECTROMAGNETIC FUEL INJECTOR DAMPENING DEVICE

CROSS-REFERENCE TO RELATED APPLICATIONS

This application claims the benefit of U.S. Provisional Application Serial No. 60/175,209, filed Jan. 10, 2000.

FIELD OF THE INVENTION

The present invention relates to fuel injectors for delivery of fuel to the intake system of an internal combustion engine and, more particularly, to an electromagnetic fuel injector that includes a dampening device applied to a moveable valve assembly. Most particularly, the present invention relates to an electromagnetic fuel injector dampening device that includes a internal adjustment for setting valve assembly stroke.

BACKGROUND OF THE INVENTION

It is most desirable, in a modern internal combustion engine, to precisely control the flow of fuel to the combustion chamber, in order to meet performance requirements, as well as emission regulations. Various types of electromagnetic fuel injectors, which precisely control the flow of fuel through a valve seat, have been used for this purpose. Generally, an electromagnetic fuel injector incorporates a solenoid armature, located between the pole piece of the solenoid and a fixed valve seat—the armature operates as a moveable valve assembly.

Electromagnetic fuel injectors are linear devices that meter fuel per electrical pulse at a rate proportional to the width of the electrical pulse. The specific relationship between pulse width and fuel delivered or metered through the injector is dependent on the injector's static flow, which typically is controlled by the stroke of the armature or moveable valve assembly of the injector, and its dynamic flow, which typically is a function of the closing force exerted on the moveable valve assembly by a spring load. U.S. Pat. No. 5,312,050, the disclosure of which is incorporated herein by reference, describes a fuel injector that engages an armature return spring and a center pole piece to vary, respectively, the dynamic and static flow characteristics of the fuel injector.

When an injector is energized, its moveable valve assembly is released from one stop position and accelerated by a spring towards the opposite stop position, located at the valve seat, the distance between the stop positions constituting the "stroke." As applied to fuel injectors, the term "bounce" refers to the condition where the moveable valve assembly inside the injector "bounces" off the valve seat one or more times after initial impact. Bounce at the valve seat is generally undesirable because it can cause unwanted fuel injection, which, because there is insufficient time for the excess fuel to be burned, has a deleterious effect on emissions.

Direct injection of gasoline, where the injector is positioned to inject fuel directly into the combustion chamber, requires a relatively high fuel pressure to operate. For example, a direct injection gasoline injector requires a pressure as high as 1700 psi or higher to operate while a typical port fuel injector requires a pressure of only approximately 60 psi to operate. The higher pressure of the direct injection gasoline injector requires the exertion of higher magnetic and spring forces on the valve assembly to operate properly. In turn, the higher the final velocity, the greater the mass of the moveable valve assembly, and the stiffer the valve assembly is at impact, the more likely is the occurrence of bounce.

The stroke through which the moveable valve assembly operates also effects the likelihood of bounce—the greater the stroke, the more likely bounce will occur. The accuracy at which the pole piece and the fixed valve seat can be positioned relative to each other and the consistency at which the valve assembly stroke can be set is therefore important.

Thus, there is a need for a fuel injector in which the movement of the valve assembly is dampened to reduce bounce. There is also a need in the art for a fuel injector wherein the stroke of the moveable valve assembly can be precisely and repeatedly controlled. These needs are met by the present invention.

SUMMARY OF THE INVENTION

The present invention, in one form thereof, is directed to a fuel injector having a body with a fuel inlet and a fuel outlet and a base. The base, which is sealably connected to the body, includes a valve seat. A moveable valve assembly having an armature and a valve outlet member is disposed at the fuel outlet for controlling the flow of fuel from the outlet. Positioned between the armature and valve outlet member is a dampening device that acts on the moveable valve assembly to reduce bounce of the valve outlet member at the valve seat.

Further in accordance with the present invention is an electromagnetic fuel injector having a body with a fuel inlet and a fuel outlet and a base. The base, which is sealably connected to the body, includes a valve seat. A moveable valve assembly having an armature and valve outlet member includes a pintle and a ball element that is disposed at the fuel outlet to control the flow of fuel from the outlet. At least one spring, positioned between the armature and the valve outlet member, acts on the moveable valve assembly to reduce bounce of the valve outlet member at the valve seat. The present invention also includes a means for adjusting the internal stroke of the injector after the injector is assembled.

BRIEF DESCRIPTION OF THE DRAWINGS

The above-mentioned and other features and advantages of this invention, and the manner of attaining them, will become apparent and be better understood by reference to the following description of the invention in conjunction with the accompanying drawings, wherein:

FIGS. 1, 2, 3 and 4 are cross-sectional views of valve assemblies of an electromagnetic fuel injector embodiment according to the present invention.

DETAILED DESCRIPTION OF THE PREFERRED EMBODIMENT

Figure 3:
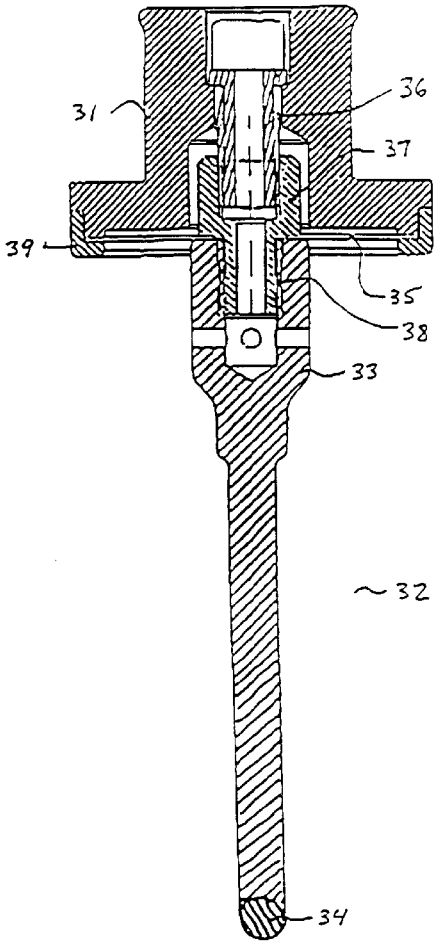

FIG. 1 depicts a valve assembly 10 wherein an armature 11 is attached via a threaded connection 12 to a valve outlet member 13 that comprises a pintle 14 and a ball element 15. Threaded connection 12 includes sufficient clearance to allow armature 11 and valve outlet member 13 to move relative to one another even when they are threaded together by connection 12. A dampening device 16, for example, a disk spring or an elastic cushion such as a rubber ring, positioned between armature 11 and valve outlet member 13 absorbs the relative motion between them, allowing armature 11 to be loaded away from valve outlet member 13. Upon closing of the injector, armature 11 and valve outlet member 13, urged by spring 17, move toward and impact the injector valve seat (not shown), the energy associated with the mass of armature 11 being absorbed by dampening device 16 and the clearance in threaded connection 12. The movement of armature 11 continues briefly even after impact with the valve seat. The energy associated with the mass of armature 11 deflects the dampening device 16 and at least some of the clearance in threads of threaded connection 12. With the effect of the larger mass of armature 11 dampened out of the initial impact, the lesser mass of valve outlet member 13 by itself is insufficient to cause a bounce. Thus, contact of valve outlet member 13 with the valve seat is maintained. In the absence of dampening device 16, valve outlet member 13 undergoes one or more bounces, each resulting in unwanted fuel injection.

Although the total moving mass is not changed, separating the bulk of the mass, concentrated in armature 11, of valve assembly 10 from the impacting component, valve outlet member 13, by dampening device 16 causes the initial impacting mass to be greatly reduced, resulting in a reduction in initial impact energy. Consequently, there is insufficient energy remaining in the collision to cause a bounce. This benefit is realized without sacrificing armature mass/magnetic force, stroke, or response time and without increasing sensitivity to injector calibration. Reducing the force of impact also is advantageous for reducing wear of valve outlet member 13 and the valve seat.

In FIG. 2 is depicted a valve assembly 20, which, like assembly 10 of FIG. 1, also provides for dampening out the mass of an armature 21, thereby substantially eliminating bounce. Valve assembly 20 further includes a valve outlet member 22 that comprises a pintle 23 and a ball element 24. Proximate its interface surface 27 with armature 21, pintle 23 has a projecting shoulder 25 on which is positioned a dampening device 26 that is in contact with armature 21. Dampening device 26, which can comprise, for example, two disk springs 26*a* and 26*b*, is guided by interface surface 27, which provides sufficient clearance to permit pintle 23 and armature 21 to move freely relative to one other.

Adjuster 28 that comprises a head 201, an axial throughbore 202 that provides a fuel flow channel, and shank 203 connect armature 21 to pintle 23, which includes corresponding adjuster bore 204. Armature axial aperture 206 provides clearance for adjuster shank 203. When adjuster 28 is advanced into pintle 23, adjuster head 201 engages a shoulder 205 in armature 21, causing it to draw closer to pintle 23, thereby preloading, i.e., compressing dampening device 26.

Dampening device 26 of valve assembly 20 functions in substantially the same manner as dampening device 16 in assembly 10, the energy associated with the mass of armature 21 being absorbed by disk springs 26*a* and 26*b*, thereby reducing the energy of collision between valve outlet member 22 and a valve seat (not shown). As will be described in the discussion of FIG. 4, valve assembly 20, when incorporated in a fuel injector, offers a further advantage of enabling adjustment of the internal stroke of the injector.

FIG. 3 depicts a valve assembly 30 that includes an armature 31 and a valve outlet member 32 comprising a pintle 33 and a ball element 34. When included in a fuel injector, valve assembly 30, like assemblies 10 and 20, also substantially eliminates bounce. A dampening device 35, for example, a flat disk spring is clamped to pintle 33, using a fastener 37. Dampening device 35 is then clamped to armature 31 using a retainer 39. Armature 31 and pintle 33 are thereby connected but remain free to move relative to one another, their motion being guided by the flat disk spring comprising dampening device 35. Similarly to valve assembly 20, advancement of adjuster 36 into fastener 37 in valve assembly 30 adjusts the internal stroke of the injector.

Figure 4:
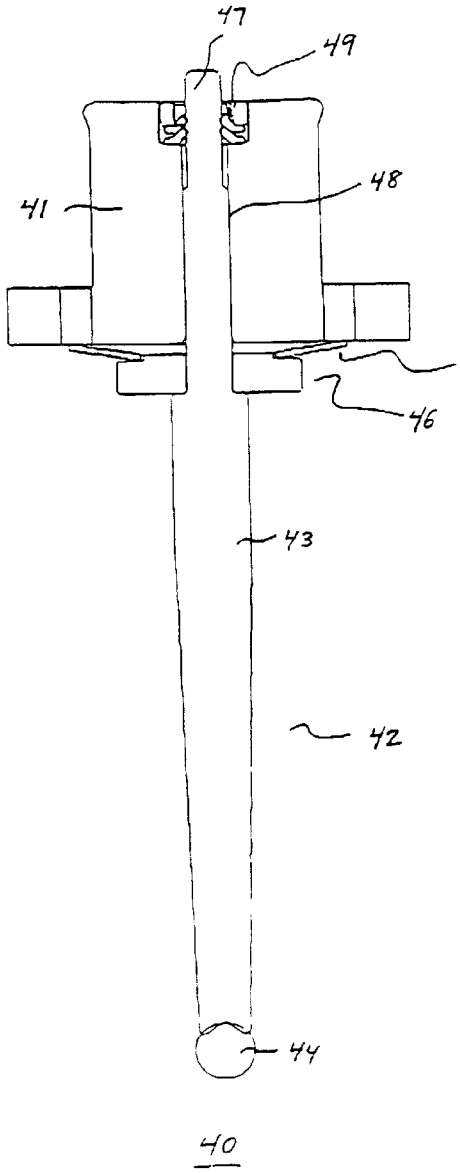

FIG. 4 depicts a valve assembly 40 that includes an armature 41 and a valve outlet member 42 comprising a pintle 43 and a ball element 44. When included in a fuel injector, valve assembly 40, like assemblies 10, 20, and 30, also substantially eliminates bounce. Armature 41 is loaded away from valve outlet member 42 by a dampening device 45, for example, a flat disk spring that is held against armature 41 by seat means comprising, for example, a circumferential washer 46 that is attached to pintle 43 proximate armature 41. An end portion 47 of pintle 43 remote from its connection with ball element 44 extends through a bore 48 in armature 41. Pintle 43 is secured within bore 48 by one or more retaining clips 49, whose position on pintle end portion 47 can be adjusted to provide a specified internal stroke following assembly of the fuel injector (not shown). Armature 41 and pintle 43 of valve outlet member 42 are thereby connected but remain free to move relative to one other to provide a dampening effect that reduces bounce.

Figure 5:
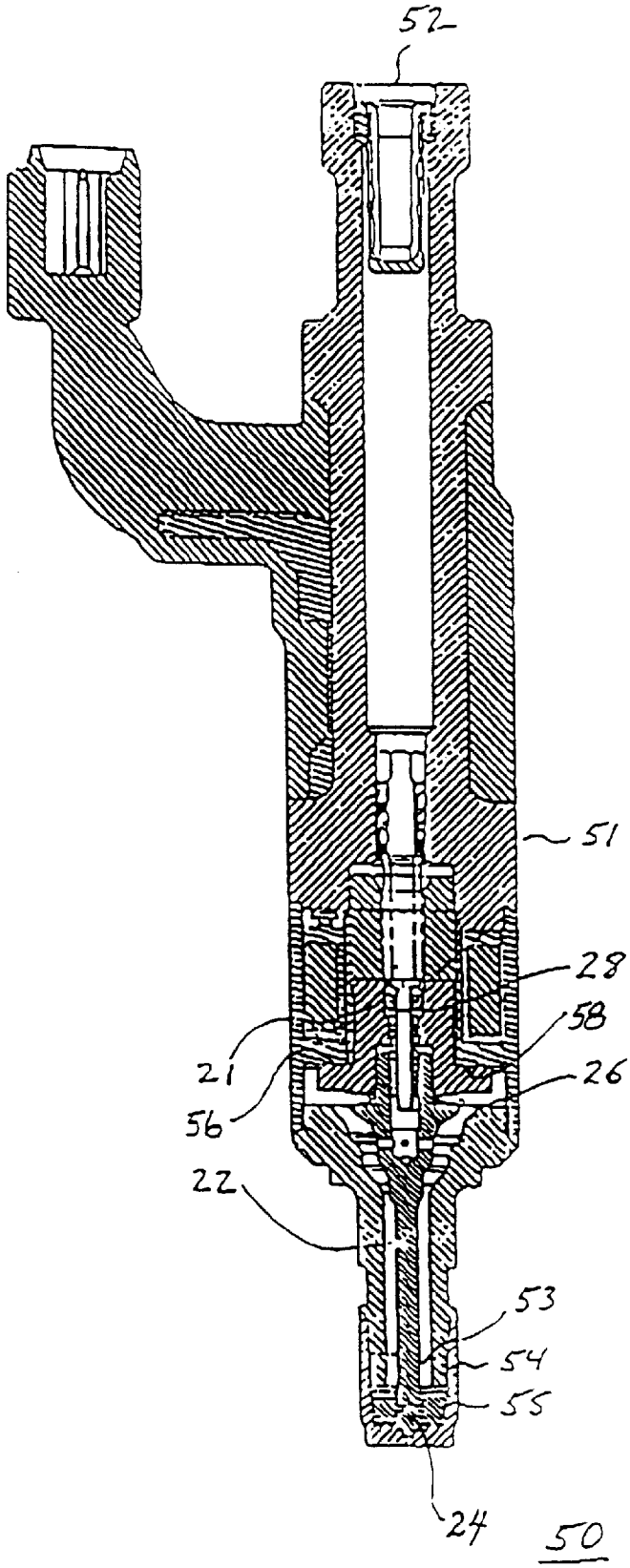
FIG. 5 is a cross-sectional view of a fuel injector in accordance with the present invention.

FIG. 5 depicts a fuel injector 50 that comprises a body 51 that has a fuel inlet 52 and a fuel outlet 53 and a base 54 that includes a valve seat 55 and is sealably connected to body 51. Armature 21 and valve outlet member 22 of valve assembly 20 (cf. FIG. 2) are pre-assembled to a predetermined height, then assembled into injector 50. The pre-determined height of the valve assembly 20 and the assembled dimensions of injector 50 determine the stroke of the armature between the injector's full open position when the armature shoulder surface 56 contacts pole piece surface 58 and the injector's closed position when ball element 24 contacts valve seat 55. Dampening device 26 keeps armature 21 and valve outlet member 22 loaded away from each other while at the same time providing sufficient clearance to allow them to move relative to one another.

After final assembly of injector 50, its stroke can be adjusted by inserting a tool such as a screwdriver or pin (not shown) to engage, and axially advance adjuster 28. Advancing adjuster 28 draws armature 21 and valve outlet member 22 closer together, compressing dampening device 26, and increasing the stroke of injector 50. Conversely, axially retracting adjuster 28 would reduce the stroke of injector 50. Valve assemblies 30 or 40 could be used in place of valve assembly 20 in constructing a fuel injector of the present invention and in adjusting the stroke as described above, after final assembly of the injector is completed.

The provision for stroke adjustment in the fuel injector of the present invention enables exact setting of the stroke without the need for very tight tolerances or expensive matching processes and also avoids the stroke varying effects of assembly processes such as welding and crimping of the various components of the injector. The ability to reset the stoke after final assembly is advantageous for reducing the rejection rate of assembled injectors.

In the embodiments shown, element 15 of valve outlet member 13, element 24 of valve outlet member 22, and element 34 of valve outlet member 32 are configured in the shape of a ball. However, it is understood that elements 15, 24, and 34 may take virtually any other shape suitable for seating with their corresponding valve seats.

In the embodiments shown, it is understood that adjusters 28 and 36 may be threaded or press fittedly inserted into the valve outlet members to achieve the described stroke adjustment. It is also understood that fastener 37 may be threaded, press fittedly inserted or riveted to the outlet member.

The invention has been described in detail for the purpose of illustration, but it is understood that such detail is solely for that purpose, and variations can be made therein by those skilled in the art without departing from the spirit and scope of the invention, which is defined by the following claims.

What is claimed is:

1. An electromagnetic fuel injector, comprising:

a body having a fuel inlet and a fuel outlet;

a base comprising a valve seat connected to said body;

a moveable valve assembly comprising an armature and a valve outlet member, said outlet member having an interface surface with said armature and a projecting shoulder proximate said interface surface, said outlet member being disposed at said fuel outlet for controlling the flow of fuel from said outlet; and dampening means disposed on said shoulder and in contact with said armature, said dampening means positioned between said armature and said valve outlet member, said dampening means acting on said moveable valve assembly to reduce bounce of said valve outlet member at said valve seat.

2. The fuel injector of claim 1, wherein said dampening means comprises an elastic cushion.

3. The fuel injector of claim 2 wherein said dampening means comprises a rubber ring.

4. The fuel injector of claim 1, wherein said dampening means comprises at least one spring.

5. The fuel injector of claim 4 wherein said dampening means comprises at least one disk spring.

6. The fuel injector of claim 1, wherein said valve outlet member comprises a pintle and a ball element.

7. The fuel injector of claim 1, wherein said armature and said valve outlet member each has a mass, the mass of said armature being greater than the mass of said valve outlet member.

8. The fuel injector of claim 1, wherein said armature and said valve outlet member are connected by corresponding screw threads on said armature and said valve outlet member.

9. The fuel injector of claim 1, wherein said valve outlet member comprises an interface surface with said armature and further comprises a projecting shoulder proximate said interface surface.

10. The fuel injector of claim 1 wherein said dampening means comprises at least one disk spring.

11. The fuel injector of claim 1, further comprising means for adjusting the internal stroke of said injector.

12. The fuel injector of claim 11 wherein said means for adjusting the internal stroke of said injector comprises an adjuster connecting said armature and said valve outlet member, wherein axial movement of said adjuster acts to increase or decrease the stroke of said injector.

13. An electromagnetic fuel injector, comprising:

a body having a fuel inlet and a fuel outlet;

a base comprising a valve seat connected to said body;

a moveable valve assembly comprising an armature and a valve outlet member, said outlet member having an interface surface with said armature and a projecting shoulder proximate said interface surface, said outlet member being disposed at said fuel outlet for controlling the flow of fuel from said outlet; and a dampening means positioned between said armature and said valve outlet member, said dampening means clamped to said armature, said dampening means acting on said moveable valve assembly to reduce bounce of said valve outlet member at said valve seat.

14. An electromagnetic fuel injector, comprising:

a body having a fuel inlet and a fuel outlet;

a base comprising a valve seat connected to said body;

a moveable valve assembly comprising an armature and a valve outlet member, said outlet member having an interface surface with said armature and a projecting shoulder proximate said interface surface, said outlet member being disposed at said fuel outlet for controlling the flow of fuel from said outlet; and a dampening means positioned between said armature and said valve outlet member, said dampening means connected to said valve outlet member by fastener means, said dampening means acting on said moveable valve assembly to reduce bounce of said valve outlet member at said valve seat.

15. The fuel injector of claim 14 wherein said fastener means comprises a press fit pin.

16. An electromagnetic fuel injector, comprising:

a body having a fuel inlet and a fuel outlet;

a base comprising a valve seat connected to said body;

a moveable valve assembly comprising an armature and a valve outlet member, said outlet member having an interface surface with said armature and a projecting shoulder proximate said interface surface, said armature connected to said valve outlet member by an adjuster inserted in an axial aperture in said armature and extending to a corresponding adjuster bore disposed in said valve outlet member, said outlet member being disposed at said fuel outlet for controlling the flow of fuel from said outlet; and a dampening means positioned between said armature and said valve outlet member, said dampening means acting on said moveable valve assembly to reduce bounce of said valve outlet member at said valve seat.

17. The fuel injector of claim 16 wherein said adjuster includes an axial throughbore, said throughbore comprising a fuel channel.

18. An electromagnetic fuel injector, comprising:

a body having a fuel inlet and a fuel outlet;

a base comprising a valve seat connected to said body;

a moveable valve assembly comprising an armature and a valve outlet member, said outlet member having an interface surface with said armature and a projecting shoulder proximate said interface surface, said armature including an attached circumferential washer, said washer comprising seat means for holding said dampening means in loaded contact with said armature, said outlet member being disposed at said fuel outlet for controlling the flow of fuel from said outlet; and a dampening means positioned between said armature and said valve outlet member, said dampening means acting on said moveable valve assembly to reduce bounce of said valve outlet member at said valve seat.

* * * * *